US010272982B1

(12) United States Patent
McGraw

(10) Patent No.: US 10,272,982 B1
(45) Date of Patent: Apr. 30, 2019

(54) TROLLING MOTOR ANCHOR MOUNT

(71) Applicant: Malcom S. McGraw, Levant, ME (US)

(72) Inventor: Malcom S. McGraw, Levant, ME (US)

( * ) Notice: Subject to any disclaimer, the term of this patent is extended or adjusted under 35 U.S.C. 154(b) by 0 days.

(21) Appl. No.: 15/956,587

(22) Filed: Apr. 18, 2018

(51) Int. Cl.

| | |
|---|---|
| ***B63H 5/20*** | (2006.01) |
| ***B63H 5/125*** | (2006.01) |
| ***B63H 20/08*** | (2006.01) |
| ***B63H 20/10*** | (2006.01) |
| ***B63H 20/00*** | (2006.01) |
| ***B63H 20/06*** | (2006.01) |
| ***B63B 19/08*** | (2006.01) |

(52) U.S. Cl.
CPC ..... *B63H 20/10* (2013.01); *B63B 19/08* (2013.01); *B63H 20/007* (2013.01); *B63H 20/06* (2013.01); *B63B 2019/083* (2013.01); *B63B 2704/00* (2013.01); *B63H 2020/103* (2013.01)

(58) Field of Classification Search
CPC ..... B63H 20/007; B63H 20/02; B63H 20/06; B63H 20/08; B63H 20/10; B63H 20/106; B63H 2020/02; B63H 2020/08; B63H 2020/10; B63H 2020/103; B63B 19/08; B63B 2019/08; B63B 2019/083; B63B 19/2704
USPC ..... 440/53, 55, 62, 63, 64, 65
See application file for complete search history.

(56) References Cited

U.S. PATENT DOCUMENTS

| | | | | |
|---|---|---|---|---|
| 4,824,067 | A | 4/1989 | O'Brien | |
| 5,029,800 | A | 7/1991 | Ponican | |
| 8,943,990 | B2 * | 2/2015 | McQuade ..... | B63H 20/007 114/230.16 |
| 9,278,745 | B2 | 3/2016 | Kooi, Jr. et al. | |
| 2009/0293793 | A1 * | 12/2009 | Silver ..... | B63B 21/26 114/294 |

* cited by examiner

*Primary Examiner* — Daniel V Venne

(74) *Attorney, Agent, or Firm* — Anthony D. Pellegrini

(57) ABSTRACT

A trolling motor mount intended for a larger watercraft having a bow-mounted anchoring system, with the trolling motor mount having a horizontal mounting platform, a vertical extension member, and a shank, with the horizontal mounting platform being suitably configured to attach a standard trolling motor thereto, the shank being suitably configured to attach to the anchoring system of the watercraft in place of the anchor, and the vertical extension member being of sufficient length to allow the trolling motor to properly reach the water when the trolling motor mount is securely attached to the watercraft by the anchoring system.

20 Claims, 7 Drawing Sheets

TROLLING MOTOR ANCHOR MOUNT

BACKGROUND OF THE INVENTION

The present invention relates generally to accessories for marine watercraft. More particularly, the present invention relates to a novel mounting device for mounting a standard electric trolling motor onto a watercraft using the watercraft's existing anchoring system, thereby allowing for the use of a trolling motor on larger watercraft without requiring any modification to the watercraft or to the trolling motor.

Trolling motors are typically low powered, low speed electric motors used to propel small watercraft. They are comprised of a motor portion, an elongate shaft, and a propeller. The motor portion is located at one end of the shaft and the propeller is located at the other end of the shaft. The motor portion generates the power, which is mechanically conveyed down the shaft to rotate the propeller. During operation, the propeller is placed below the water's surface.

Trolling motors often also comprise an attachment bracket having a pivot means; the bracket is used to attach the trolling motor to the watercraft, while the pivot means allows the trolling motor to be pivoted between two modes: an operational mode, whereby the trolling motor is oriented substantially vertically with the propeller submerged in the water, and a stowage mode, whereby the trolling motor is oriented substantially horizontally with the propeller out of the water. Trolling motors are primarily used for fishing, because they are quiet and can move the watercraft very slowly with little disturbance of the water. They can also be used to more accurately position a watercraft, for example, to facilitate docking. Trolling motors are now frequently used for assisting with anchoring by being integrated with a GPS system, thereby permitting precise positioning of the watercraft. Trolling motors with GPS capability are used to quickly locate, stop over, and remain directly over a school of fish, providing a significant advantage over conventional anchoring in place using an anchor and a long rope (which cannot be used at all in deep water).

Trolling motors are typically mounted onto the watercraft at the bow end, so as to avoid conflict with the primary propulsive motor usually located at the stern end, though stern mounting also occurs. Steering a watercraft with a low powered motor is much easier when the motor is located on the bow of the watercraft rather than on the stern. A bow mounted trolling motor is typically mounted onto the deck of the watercraft, or even onto the bow rail. A stern mounted trolling motor is typically mounted onto the transom of the watercraft, or sometimes onto a swim platform.

With regard to bow mounted trolling motors, the shaft connecting the motor component to the propeller has a sufficient length to allow the propeller to be submerged when the trolling motor is in operational mode only if the watercraft is relatively small. That is, a sixteen or twenty foot long boat has a deck that is fairly low to the waterline, so that the shaft of a deck mounted trolling motor easily reaches the water during operational mode. In even smaller boats, a trolling motor attached to the top of a bow rail is still able to reach the water. These types of boats are typically used on lakes and rivers and near shore on the ocean. However, in larger offshore boats, having a length of twenty-five feet or more, the deck is much higher off the waterline. A standard trolling motor's shaft is not long enough to allow the propeller to be submerged if the motor is mounted on the deck. In order to use a bow mounted trolling motor on such a boat, the trolling motor would need to have a custom made shaft, at great expense. Thus, bow mounted trolling motors are rarely seen on larger watercraft. Stern mounted or swim platform mounted trolling motors might work for larger watercraft, but they tend to interfere with the main propulsive motor, and with regard to swim platform mounted trolling motors, such applications necessarily limit the primary usefulness of the swim platform.

It is thus shown that there is a need for a device that would enable a standard trolling motor to be used on larger watercraft in a bow mounted configuration.

It is therefore an object of the present invention to present a trolling motor mount which can be used to mount standard trolling motors to larger watercraft in a bow mounted configuration.

It is a further object of the present invention to present a trolling motor mount which can be easily attached to a watercraft without the need for tools or modification of the watercraft.

It is yet a further object of the present invention to present a trolling motor mount which attaches to the existing anchoring system of a watercraft.

It is yet a further object of the present invention to present a trolling motor mount which may extended for use on different sized watercraft.

Other objects of the present invention will be readily apparent from the description that follows.

SUMMARY OF THE INVENTION

Most larger watercraft are equipped with automatic anchoring systems integrated into the bow. These systems comprise an anchor compartment formed into the bow, with an opening through the hull below the deck. Within the anchor compartment is an anchor chain take-up device, typically a powered windlass which winds the anchor chain, located towards the back of the anchor compartment and furthest from the opening in the hull. Forward of the take-up device is an anchor receiving device, which accommodates at least a portion of the anchor, primarily the anchor shank. This could be a set of rails, or rollers, or just a metal plate along which the anchor shank can slide. When the anchor is raised, the take-up device winds the anchor chain, drawing the anchor out of the water and into the anchor compartment. When the chain is fully wound the anchor is snugged up against a bow-mounted roller located exterior to and just below the anchor compartment, and the anchor shank sits within the anchor receiving device, secured within the anchor compartment against the take-up device.

Some watercraft have an anchoring systems located on the deck, rather than located within an anchor compartment as described above. Notwithstanding the location, though, deck-mounted anchoring systems still have an anchor chain take-up device, an anchor receiving device, and a bow-mounted roller, as described above, and operation of the anchoring system is the same. The only difference is that the shank of the anchor rests on the deck rather than within an anchor compartment when the chain is fully wound in this alternate configuration.

The present invention is a trolling motor mount intended for larger watercraft having either of the anchoring systems as described above. In order to allow a standard trolling motor to reach the water, the trolling motor mount of the present invention provides a horizontal mounting platform located well below the deck of the watercraft onto which a trolling motor may be mounted using its standard mounting bracket. The trolling motor mount has a vertical extension member rising upwards from the mounting platform and a shank configured similarly to an anchor shank extending at an angle from the top of the extension member.

The trolling motor mount is secured to the watercraft using the anchoring mechanism as described above, as follows: the take-up device slightly unwinds the anchor chain thereby freeing the anchor from the anchor compartment (or the deck) of the watercraft; the anchor is detached from the anchor chain; the shank of the trolling motor mount is attached to the anchor chain in the same manner as the anchor shank was attached to the chain; then the anchor take-up device fully retracts the anchor chain, resulting in the shank of the trolling motor mount being secured within the anchor compartment (or onto the deck) just as the anchor shank would be. The vertical extension member and the horizontal mounting platform hang below the anchor compartment (or the deck), thereby providing a trolling motor mounting location closer to the waterline than if the trolling motor were mounted on the deck. Thus is provided a trolling motor mount system that can be easily attached to any large watercraft having an anchoring system, without needing to modify the hull of the watercraft in any way. If needed, the trolling motor mount can be easily detached from the anchor chain and replaced with an anchor.

The height of the vertical extension member of the trolling motor mount of the present invention can be altered to accommodate different sized watercraft. A typical trolling motor will have a shaft length of between four and six feet. The trolling motor should be attached to a watercraft at a point where the distance from the point of attachment to the waterline is about two feet less than the length of the shaft. Where the aperture through the hull to the anchor compartment is five feet above the waterline, the extension member of the trolling motor mount of the present invention should be about two feet long in order for a standard trolling motor with a five foot shaft to be used. If the aperture is only four feet above the waterline, a one foot long extension member could be used with a five foot long shaft, or a two foot long extension member could be used with a shorter, four foot long shaft. Similarly, distances and lengths can be measured from the deck (rather than the anchor compartment) where a deck-mounted anchoring system is used. The configurations of the trolling motor mount of the present invention are limited only by the user's preferences.

In one embodiment, the vertical extension member of the trolling motor mount may be adjustable, such that its length can be changed by the user. This allows different trolling motors (having different length shafts) to be used on the same watercraft, or one trolling motor to be used with different watercraft having different deck heights above the waterline. The vertical extension member may be extended by any known means, such as telescoping sections into each other, or having two members slidably attached to each other.

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims incorporated herein.

DETAILED DESCRIPTION OF THE INVENTION

Figure 5:
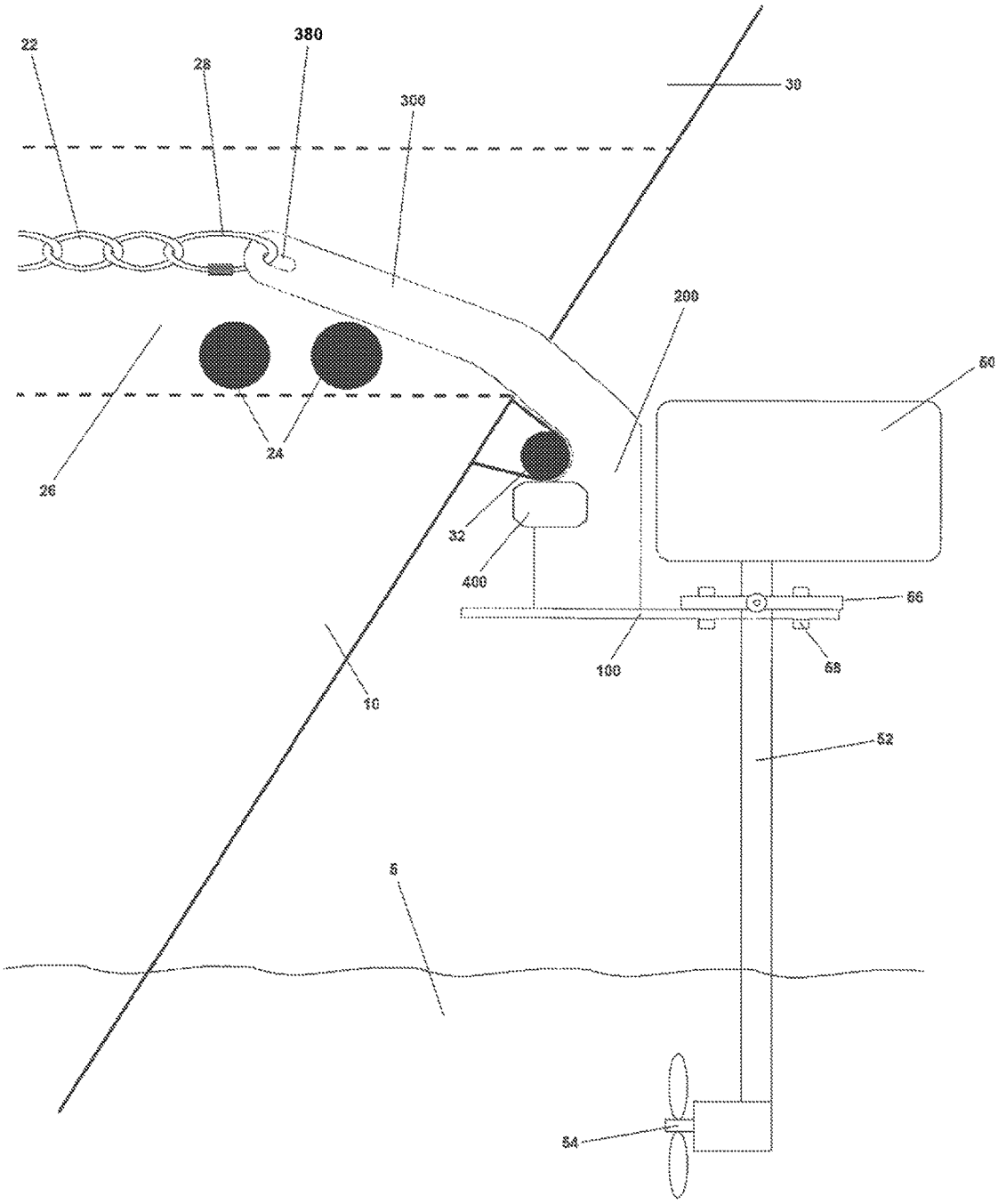
FIG. 5 is a side schematic view of an embodiment of the device claimed herein, wherein the anchoring system of the watercraft is contained within an anchor compartment located below the deck and having an opening through the hull of the watercraft. A trolling motor is shown mounted to the trolling motor mount using its standard mounting bracket.
Figure 6:
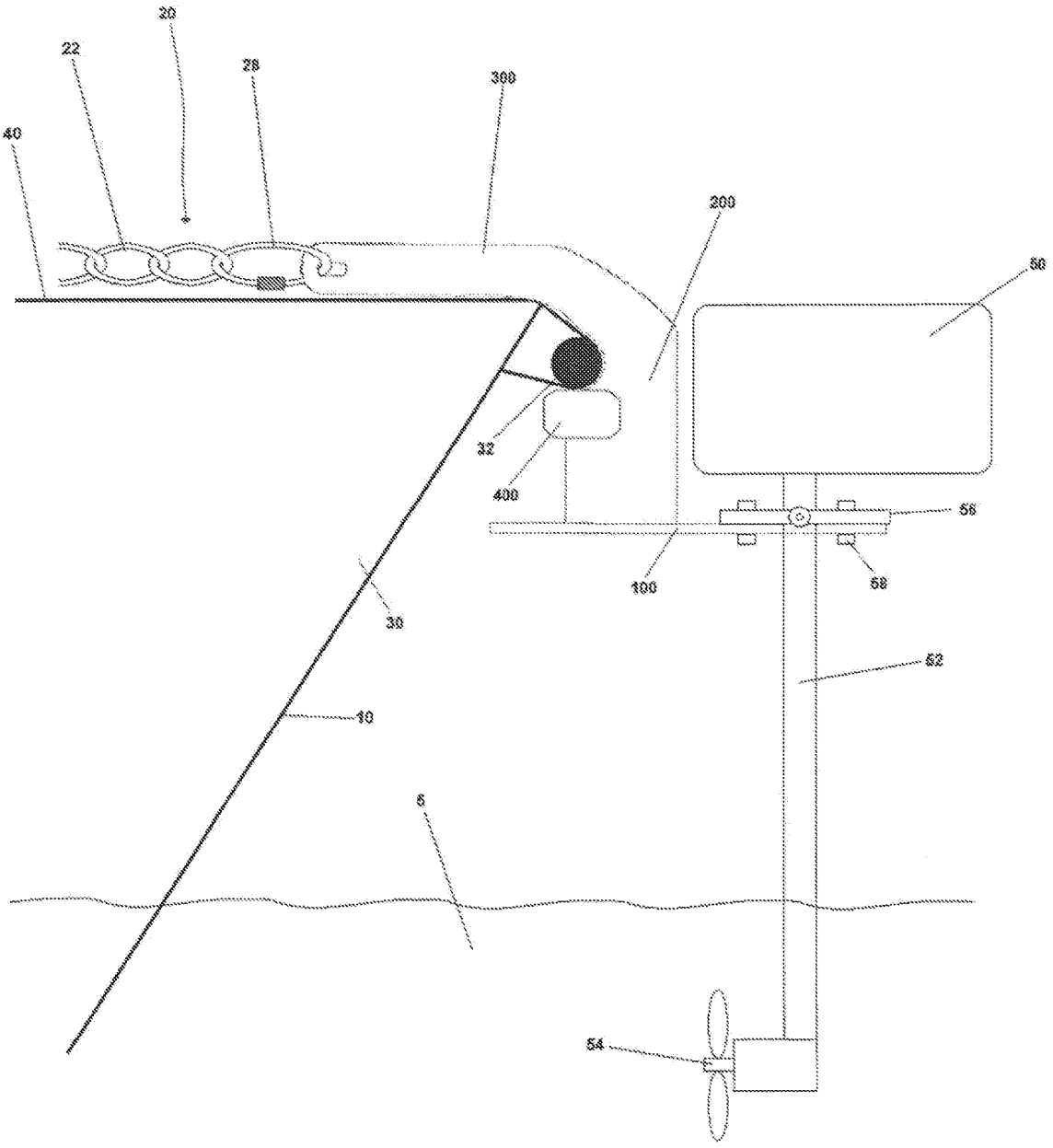
FIG. 6 is a side schematic view of an embodiment of the device claimed herein, wherein the anchoring system of the watercraft is located on the deck of the watercraft. A trolling motor is shown mounted to the trolling motor mount using its standard mounting bracket.

The present invention is a trolling motor mount 1 for use on a watercraft 10 having an anchoring system 20. The anchoring system 20 must have an anchor chain 22 and a roller 32 mounted on the bow 30 of the watercraft 10. The trolling motor mount 1 is intended to be used with any standard trolling motor 50, with the trolling motor 50 having a shaft 52 and a propeller 54. Optionally, the trolling motor 50 may also have a mounting bracket 56. The trolling motor 50 may be mounted onto the trolling motor mount 1 using its standard mounting bracket 56, if available, for example, by the use of a plurality of mounting pins 58. See FIGS. 5 and 6. Other means for mounting the trolling motor 50 to the trolling motor mount 1 are also contemplated. Proper mounting of the trolling motor 50 ensures that its propeller 54 is submerged under water 5 during operation of the trolling motor 50.

The trolling motor mount 1 of the present invention comprises a horizontal mounting platform 100, a vertical extension member 200, a shank 300, and a roller stop 400. The horizontal mounting platform 100, the vertical extension member 200, and the shank 300 together form a rigid one piece structure, with the vertical extension member 200 located between the horizontal mounting platform 100 and the shank 300. The one piece structure may be formed by attaching the above-described components 100,200,300 to each other, for example, by welding them to each other, or they may be formed out of a single piece of material, such as a single composite plastic extrusion. Alternately, two of the three components may be formed of a single piece of material, and then attached to the third (for example, the shank 300 and the vertical extension member 200 may be formed out of a single piece of aluminum, and then this unitary component is welded to the horizontal mounting platform 100.)

Figure 2:
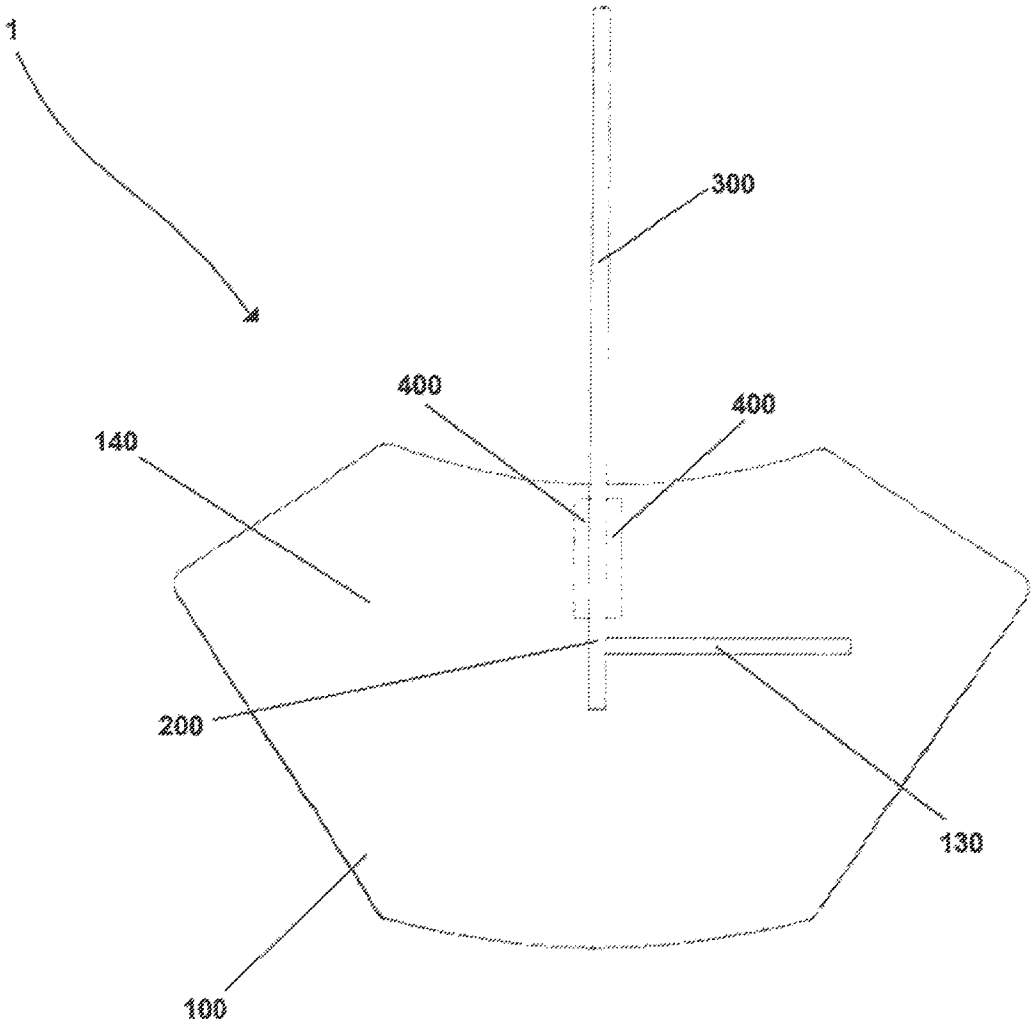
FIG. 2 is a top plan view of the embodiment of the device depicted in FIG. 1.

The horizontal mounting platform 100 is a substantially planar rigid member having a top surface 110 and a bottom surface 120. It may be constructed of any suitable material, such as steel, aluminum, stainless steel, galvanized steel, composite plastic, carbon fiber, brass, or other materials. It should have a sufficient thickness to be able to support the trolling motor 50; the thickness of the horizontal mounting platform may be between ¼ inch to 2 inches, depending on the material used. The horizontal mounting platform 100 may have any shape. In one embodiment it has a regular polygon shape. This may be a square, a rectangle, a pentagon, a hexagon, an octagon, or other regular polygon. It may have an irregular polygon shape. It may have a circular shape or an oval shape. Or it may have an irregular shape having a combination of straight edges and curves. See, e.g., FIG. 2. At least a portion of the top surface 110 of the horizontal mounting platform 100 constitutes the mounting region 140, whereby the mounting region 140 provides sufficient space to mount a standard trolling motor 50 to the horizontal mounting platform 100 without needing to modify the trolling motor 50.

Figure 1:
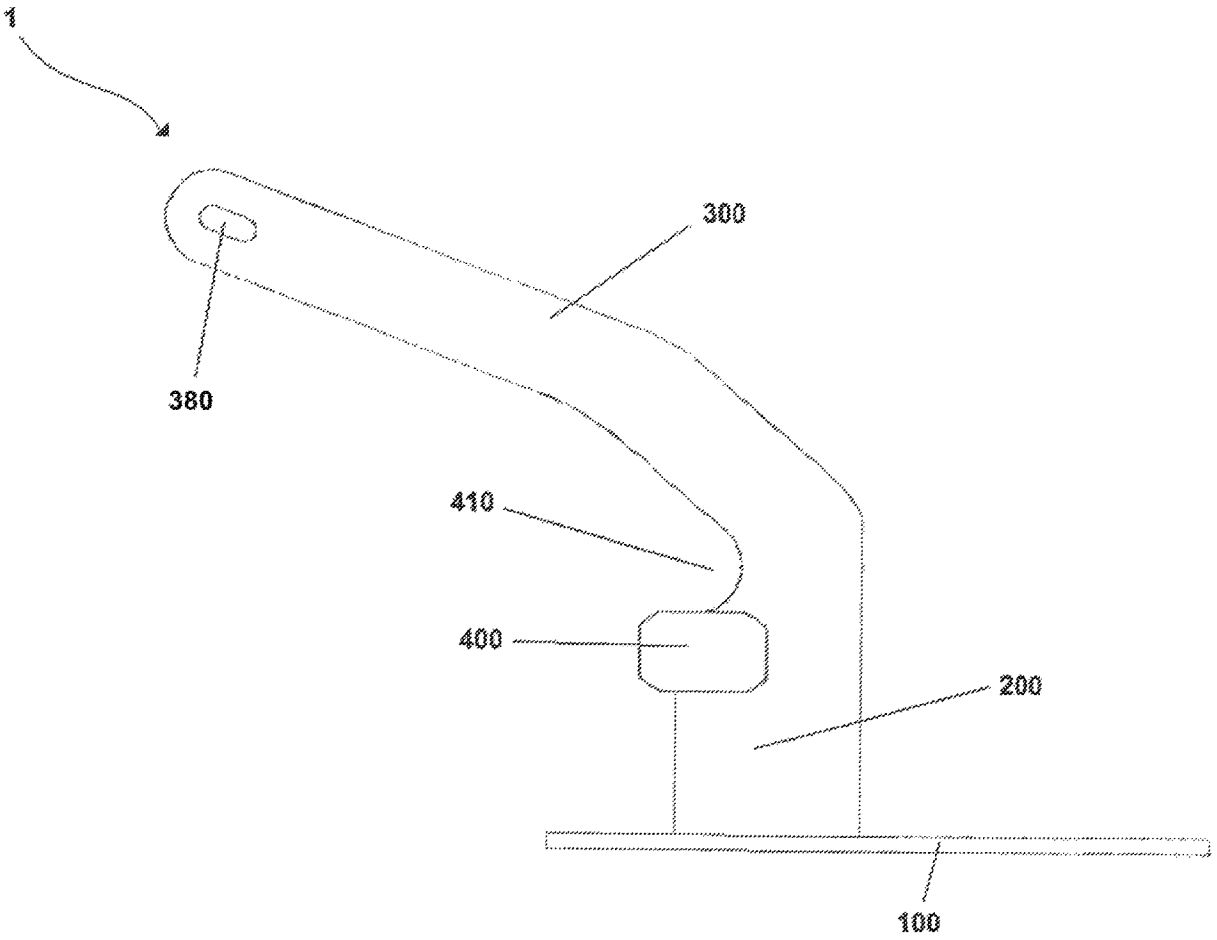
FIG. 1 is a side plan view of one embodiment of the device claimed herein.

The vertical extension member 200 is elongate and rigid, having a first end 210 and a second end 220. It is fixedly attached at its first end 210 to the top surface 110 of the horizontal mounting platform 100. In an alternative embodiment, the vertical extension member 200 is formed of a unitary component with the horizontal mounting platform 100. The vertical extension member 200 extends upward from the top surface 110 of horizontal mounting platform 100 in a substantially perpendicular orientation to the horizontal mounting platform 100. See FIG. 1. The vertical extension member 200 may be constructed of any suitable material, such as steel, aluminum, stainless steel, galvanized steel, composite plastic, carbon fiber, brass, or other materials. It may be constructed of the same material as the horizontal mounting platform 100, or it may be constructed of a different material.

In one embodiment, the vertical extension member 200 may be extendable. This may be implemented by the vertical extension member 200 having multiple sub-components with telescope into each other and then lock into place. This configuration is well known in the art. Alternatively, the vertical extension member 200 may be comprised of a pair of plates which slide against each other, again having a locking mechanism to retain the plates in fixed relation to each other once the desired height of the vertical extension member 200 is achieved. Other mechanisms known in the art are also contemplated.

The shank 300 is elongate and rigid, having a first end 310 and a second end 320. It is fixedly attached at its first end 310 to the second end 220 of the vertical extension member 200. In an alternative embodiment, the shank 300 is formed of a unitary component with the vertical extension member 200. The shank 300 extends upward from the second end 220 of the vertical extension member 200 at a first angle 340 of between 10 degrees and 89 degrees relative to the longitudinal axis 230 of the vertical extension member 200. The second end 320 of the shank 300 is oriented in a rearward direction; that is, in a direction towards the watercraft 10 relative to the vertical extension member 200 when the motor mount 1 is attached to the watercraft 10. The shank 300 may be constructed of any suitable material, such as steel, aluminum, stainless steel, galvanized steel, composite plastic, carbon fiber, brass, or other materials. It may be constructed of the same material as the vertical extension member 200, or it may be constructed of a different material.

At the second end 320 of the shank 300 is an aperture 380, configured to allow the anchor chain 22 of the anchoring system 20 of the watercraft 10 to be removably attached to the shank 300 of the motor mount 1. See FIG. 1. In this embodiment, the anchor chain 22 is removably attached to the motor mount 1 by a connector 28 attached to the end of the anchor chain 22. See, e.g., FIGS. 5 and 6. The connector 28 must be suitably configured to engage with the aperture 380 formed into the second end 320 of the shank 300. The connector 28 may be a clip, a shackle, a carabineer, a hook, or a short length of rope or cord. Other types of connectors 28 are also contemplated. In the preferred embodiment, the connector 28 is whatever mechanism is used by the anchoring system 20 of the watercraft 10 to attach the watercraft's 10 anchor to the anchor chain 22.

Figure 1A:
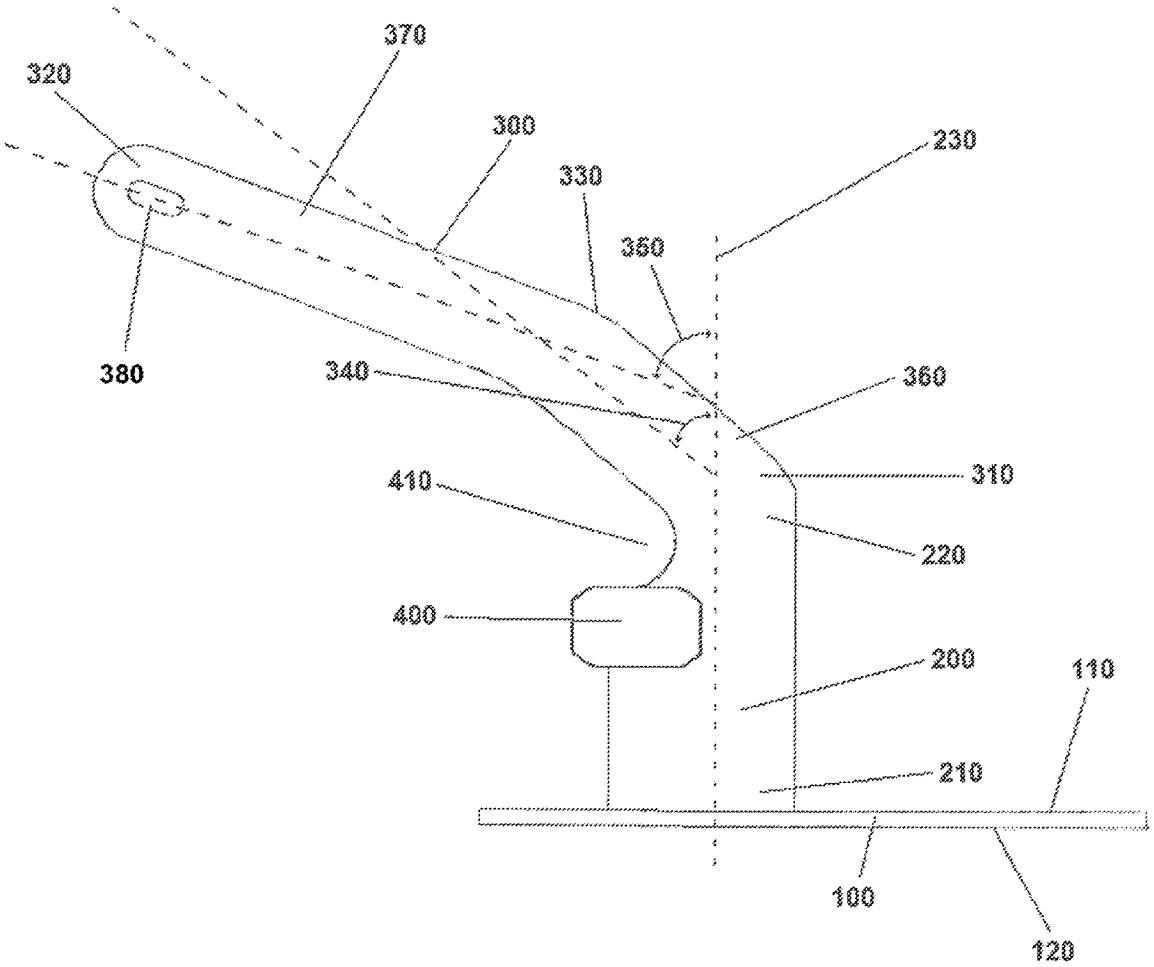
FIG. 1A is a side plan view of the embodiment of the device shown in FIG. 1, with dashed lines added to show the angle of the shank relative to the vertical extension member.

In one embodiment, the shank 300 may have a bend 330 between the first and second ends 310,320 of the shank 300. A first portion 360 of the shank 300 is located between the first end 310 of the shank 300 and the bend 330, and a second portion 370 of the shank 330 is located between the bend 330 and the second end 320 of the shank 300. See FIG. 1A. The first portion 360 of the shank 300 is at the first angle 340 relative to the longitudinal axis 230 of the vertical extension member 200. The second portion 370 of the shank 330 is at a second angle 350 relative to the longitudinal axis 230 of the vertical extension member 200. The second angle 350 is between 11 degrees and 90 degrees relative to the longitudinal axis 230 of the vertical extension member 200, and is greater than the first angle 340. See FIG. 1A.

Other configurations of the shank 300 are also contemplated. Depending on the design of the anchoring system 20 of the watercraft 10, the shank 300 may have multiple bends or curved portions.

The roller stop 400 is a rigid structure fixedly attached to the vertical extension member 200 proximate to the second end 220 of the vertical extension member 200. In an alternative embodiment, the roller stop 400 is formed of a unitary component with the vertical extension member 200. At least a portion of the roller stop 400 extends substantially perpendicular to the vertical extension member 200 in a rearward direction. See FIG. 1. The roller stop 400 may be constructed of any suitable material, such as steel, aluminum, stainless steel, galvanized steel, composite plastic, carbon fiber, brass, or other materials. It may be constructed of the same material as the vertical extension member 200, or it may be constructed of a different material.

The roller stop 400, the vertical extension member 200, and the shank 300 together form a roller cavity 410 oriented in a rearward direction. See FIG. 1. The roller cavity 410 may be configured as a semi-circle, to better fit the bow roller 32 of the watercraft, and therefore the proximate surfaces of the roller stop 400, the vertical extension member 200, and the shank 300 may be shaped to achieve this configuration. Other configurations of the roller cavity 410 are also contemplated.

The trolling motor mount 1 may further comprise one or more reinforcement members 130. Each reinforcement member 130 is substantially planar and rigid and fixedly attached to the horizontal mounting platform 100 and to the vertical extension member 200. In an alternative embodiment, the reinforcement member 130 is formed of a unitary component with the horizontal mounting platform 100 and/or the vertical extension member 200. The reinforcement member 130 may be constructed of any suitable material, such as steel, aluminum, stainless steel, galvanized steel, composite plastic, carbon fiber, brass, or other materials. It may be constructed of the same material as the horizontal mounting platform 100 and/or the vertical extension member 200, or it may be constructed of a different material.

Figure 3:
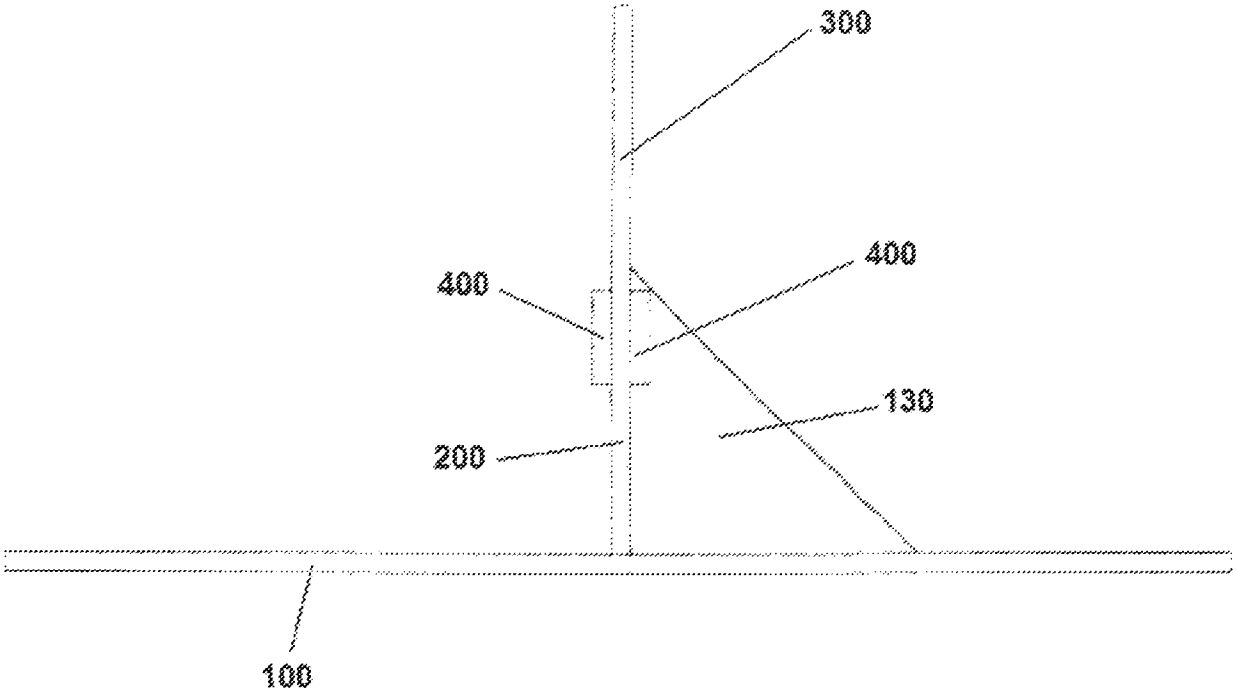
FIG. 3 is a front plan view of the embodiment of the device depicted in FIG. 1.
Figure 4:
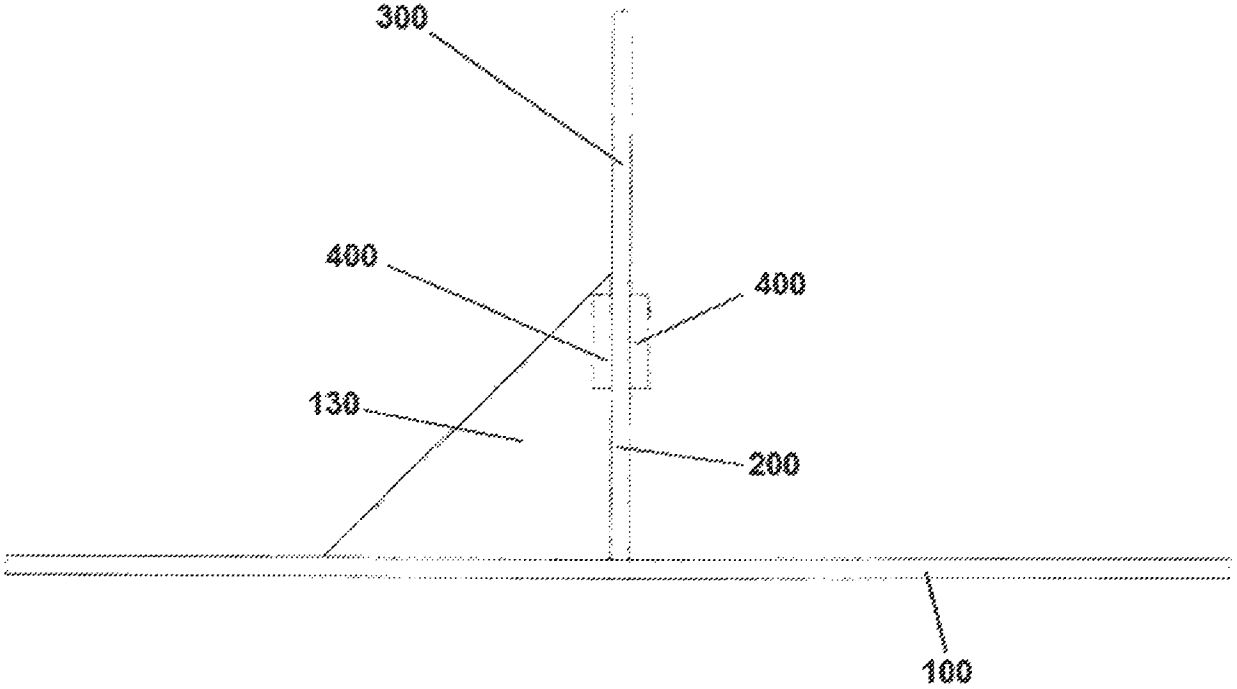
FIG. 4 is a rear plan view of the embodiment of the device depicted in FIG. 1.

In one embodiment the reinforcement member 130 is attached to the top surface 110 of the horizontal mounting platform 100 and to the side of the vertical extension member 200 between the first and second ends 210,220 of the vertical extension member 200. See FIGS. 3 and 4. In another embodiment the reinforcement member 130 is attached to the bottom surface 120 of the horizontal mounting platform 100 and to the first end 210 of the vertical extension member 200. Other configurations of the reinforcement member are also contemplated.

The trolling motor mount 1 is used by removably attaching the trolling motor 50 to the mounting region 140 of the horizontal mounting platform 100 using standard mounting mechanisms. In one embodiment holes are drilled through the horizontal mounting platform 100 and the trolling motor bracket 56 is attached to the horizontal mounting platform 100 by a plurality of mounting pins 58. Once the trolling motor 50 is attached to the motor mount 1, the anchor chain 22 of the anchoring system 20 of the watercraft 10 is attached to shank 300 of the motor mount 1. Prior to attachment, the anchor chain 22 is let out a short amount to provide slack to facilitate mounting. Once the motor mount 1 is attached to the anchor chain 22, the anchor chain 22 is retracted into the anchor compartment 26. This causes the shank 300 of the motor mount 1 to also be drawn into the anchor compartment 26, typically over a series of rollers 24 to facilitate movement. See FIG. 5. As the anchor chain 22 is retracted, the roller cavity 410 of the motor mount 1 comes into contact with the bow roller 32 of the watercraft 10. Continued retraction of the anchor chain 22 causes the motor mount 1 to snugly engage with the bow roller 32, and is thereby held securely in place by the tension exerted by the anchor chain 22.

Where the watercraft 10 does not have an anchor compartment 26, but rather has its anchoring system 20 mounted onto the deck 40, the process for using the motor mount 1 is the same as described above except that the shank 300 of the motor mount 1 is drawn onto the deck 40 by the anchor chain 22. See FIG. 6. Rollers 24 may or may not be used to facilitate movement of the shank 300 onto the deck 40.

Modifications and variations can be made to the disclosed embodiments of the device of the present invention without departing from the subject or spirit of the invention as defined in the following claims.

I claim:

1. A motor mount for a trolling motor, said motor mount configured to be attached to a watercraft having a retractable anchoring system comprising an anchor chain and a roller mounted on the watercraft, said motor mount comprising:

a horizontal mounting platform;

a vertical extension member;

a shank; and a roller stop;

with the horizontal mounting platform, the vertical extension member, and the shank together forming a rigid one piece structure, with the vertical extension member located between the horizontal mounting platform and the shank;

wherein the horizontal mounting platform is a substantially planar member having a top surface and a bottom surface;

the vertical extension member is elongate, having a first end and a second end, and is fixedly attached at its first end to the top surface of the horizontal mounting platform, extending upward from the top surface of horizontal mounting platform in a substantially perpendicular orientation to the horizontal mounting platform;

the shank is elongate, having a first end and a second end, and is fixedly attached at its first end to the second end of the vertical extension member, extending upward from the second end of the vertical extension member at a first angle of between 10 degrees and 89 degrees relative to a longitudinal axis of the vertical extension member, and with the second end of the shank oriented in a rearward direction, said rearward direction being towards the watercraft relative to the vertical extension member when the motor mount is attached to the watercraft; and the roller stop is a rigid structure fixedly attached to the vertical extension member proximate to the second end of the vertical extension member, with at least a portion of the roller stop extending substantially perpendicular to the vertical extension member in the rearward direction, whereby the roller stop, the vertical extension member, and the shank form a roller cavity oriented in the rearward direction;

whereby the motor mount is used by removably attaching the trolling motor to the horizontal mounting platform of the motor mount, attaching the anchor chain of the anchoring system of the watercraft to the shank of the motor mount, and then retracting the anchor chain so that the roller of the anchoring system engages with the roller cavity of the motor mount, with tension of the anchor chain retaining the motor mount snugly against the roller.

2. The motor mount of claim 1 further comprising a reinforcement member fixedly attached to the horizontal mounting platform and to the vertical extension member.

3. The motor mount of claim 2 wherein the reinforcement member is attached to the top surface of the horizontal mounting platform and to the vertical extension member along a side of the vertical extension member between the first and second ends of the vertical extension member.

4. The motor mount of claim 2 wherein the reinforcement member is attached to the bottom surface of the horizontal mounting platform and to the first end of the vertical extension member.

5. The motor mount of claim 1 wherein the shank has a bend between the first and second ends of the shank, with a first portion of the shank being located between the first end of the shank and the bend and a second portion of the shank being located between the bend and the second end of the shank, whereby the first portion of the shank is at the first angle relative to the longitudinal axis of the vertical extension member, and the second portion of the shank is at a second angle relative to the longitudinal axis of the vertical extension member, with the second angle being between 11 degrees and 90 degrees relative to the longitudinal axis of the vertical extension member, and with the second angle being greater than the first angle.

6. The motor mount of claim 1 wherein the horizontal mounting platform is a regular polygon in shape.

7. The motor mount of claim 6 wherein the shape of the horizontal mounting platform is one of the group of: a square, a rectangle, a pentagon, a hexagon, and an octagon.

8. The motor mount of claim 1 wherein the horizontal mounting platform is an irregular polygon in shape.

9. The motor mount of claim 1 wherein the shape of the horizontal mounting platform is one of the group of: a circle, an oval, and an ellipse.

10. The motor mount of claim 1 wherein the horizontal mounting platform has an irregular shape.

11. The motor mount of claim 1 wherein the horizontal mounting platform is constructed of a material from the following group: steel, aluminum, stainless steel, galvanized steel, composite plastic, carbon fiber, and brass.

12. The motor mount of claim 1 wherein the vertical extension member is constructed of a material from the following group: steel, aluminum, stainless steel, galvanized steel, composite plastic, carbon fiber, and brass.

13. The motor mount of claim 1 wherein the shank is constructed of a material from the following group: steel, aluminum, stainless steel, galvanized steel, composite plastic, carbon fiber, and brass.

14. The motor mount of claim 1 wherein the roller stop is constructed of a material from the following group: steel, aluminum, stainless steel, galvanized steel, composite plastic, carbon fiber, and brass.

15. The motor mount of claim 1 wherein the horizontal mounting platform is welded to the vertical extension member.

16. The motor mount of claim 1 wherein the horizontal mounting platform and the vertical extension member are formed of a unitary component.

17. The motor mount of claim 1 wherein the vertical extension member and the shank are formed of a unitary component.

18. The motor mount of claim 1 wherein the horizontal mounting platform, the vertical extension member, and the shank are formed of a unitary component.

19. The motor mount of claim 1 wherein the shank further comprises an aperture located at the second end of the shank, said aperture being configured to allow the anchor chain of the anchoring system of the watercraft to be removably attached to the shank of the motor mount.

20. The motor mount of claim 19 wherein the anchor chain is removably attached to the motor mount by a connector attached to the anchor chain, said connector being suitably configured to engage with the aperture formed into the second end of the shank, said connector being one of the group of: a clip, a shackle, a carabineer, a hook, and a short length of rope.

* * * * *